US011158443B2

(12) United States Patent
Harada et al.

(10) Patent No.: US 11,158,443 B2
(45) Date of Patent: Oct. 26, 2021

(54) SOFT MAGNETIC ALLOY AND MAGNETIC DEVICE

(71) Applicant: TDK CORPORATION, Tokyo (JP)

(72) Inventors: Akihiro Harada, Tokyo (JP); Hiroyuki Matsumoto, Tokyo (JP); Kenji Horino, Tokyo (JP); Kazuhiro Yoshidome, Tokyo (JP); Akito Hasegawa, Tokyo (JP); Hajime Amano, Tokyo (JP); Kensuke Ara, Tokyo (JP); Seigo Tokoro, Tokyo (JP); Masakazu Hosono, Tokyo (JP); Takuma Nakano, Tokyo (JP); Satoko Mori, Tokyo (JP)

(73) Assignee: TDK CORPORATION, Tokyo (JP)

( * ) Notice: Subject to any disclaimer, the term of this patent is extended or adjusted under 35 U.S.C. 154(b) by 300 days.

(21) Appl. No.: 16/146,268

(22) Filed: Sep. 28, 2018

(65) Prior Publication Data

US 2019/0108931 A1 Apr. 11, 2019

(30) Foreign Application Priority Data

Oct. 6, 2017 (JP) ..... JP2017-196009

(51) Int. Cl.

| | |
|---|---|
| ***H01F 1/147*** | (2006.01) |
| ***C22C 38/14*** | (2006.01) |
| ***C22C 38/04*** | (2006.01) |
| ***C22C 38/06*** | (2006.01) |
| ***C22C 38/12*** | (2006.01) |
| ***H01F 1/153*** | (2006.01) |
| ***C22C 38/00*** | (2006.01) |

(52) U.S. Cl.

CPC ..... *H01F 1/14733* (2013.01); *C22C 38/002* (2013.01); *C22C 38/04* (2013.01); *C22C 38/06* (2013.01); *C22C 38/12* (2013.01); *C22C 38/14* (2013.01); *H01F 1/15308* (2013.01); *H01F 1/15333* (2013.01); *C22C 2200/02* (2013.01); *C22C 2200/04* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 2012/0199254 | A1* | 8/2012 | Urata | H01F 1/15308 148/579 |
| 2016/0177429 | A1 | 6/2016 | Urata et al. | |
| 2018/0073117 | A1 | 3/2018 | Urata et al. | |
| 2018/0122540 | A1* | 5/2018 | Matsumoto | C22C 38/18 |

FOREIGN PATENT DOCUMENTS

| | | | | |
|---|---|---|---|---|
| JP | S61-44111 | A | 3/1986 | |
| JP | 2002-285305 | A | 10/2002 | |
| JP | 2003-041354 | A | 2/2003 | |
| JP | 2011-195936 | A | 10/2011 | |
| JP | 6160760 | B1 * | 7/2017 | C22C 38/16 |
| JP | 6160760 | B1 | 7/2017 | |
| KR | 10-2012-0003496 | A | 1/2012 | |

* cited by examiner

*Primary Examiner* — Xiaowei Su

(74) *Attorney, Agent, or Firm* — Oliff PLC

(57) ABSTRACT

A soft magnetic alloy contains a main component having a composition formula of $(Fe_{(1-(\alpha+\beta))}X1_{\alpha}X2_{\beta})_{(1-(a+b+c+d))}M_aB_bP_cC_d$ and auxiliary components including at least Ti, Mn and Al. In the composition formula, X1 is one or more selected from the group consisting of Co and Ni, X2 is one or more selected from the group consisting of Ag, Zn, Sn, As, Sb, Bi and a rare earth element, and M is one or more selected from the group consisting of Nb, Hf, Zr, Ta, Mo, W and V. In the composition formula, $0.030 \leq a \leq 0.100$, $0.050 \leq b \leq 0.150$, $0 < c \leq 0.030$, $0 < d \leq 0.030$, $\alpha \geq 0$, $\beta \geq 0$, and $0 \leq \alpha+\beta \leq 0.50$ are satisfied. In the soft magnetic alloy, a content of Ti is 0.001 to 0.100 wt %, a content of Mn is 0.001 to 0.150 wt %, and a content of Al is 0.001 to 0.100 wt %.

20 Claims, No Drawings

SOFT MAGNETIC ALLOY AND MAGNETIC DEVICE

TECHNICAL FIELD

The present invention relates to a soft magnetic alloy and a magnetic device.

BACKGROUND

Recently, for electronic, information, and communication devices and the like, lower power consumption and higher efficiency are demanded. Furthermore, such demands are even more demanded for a low-carbon society. Hence, a reduction of an energy loss and an improvement in power supply efficiency are demanded also for power supply circuits of electronic, information, and communication devices and the like. Moreover, for a magnetic core of a magnetic element to be used in the power supply circuit, an improvement in saturation magnetic flux density, a decrease in a core loss (magnetic core loss), and an improvement in magnetic permeability are demanded. The loss of electric power energy decreases as the core loss decreases, and a higher efficiency is attained and energy is saved as the saturation magnetic flux density and the magnetic permeability are improved. As a method of decreasing the core loss of the magnetic core, it is conceivable to decrease the coercivity of the magnetic material constituting the magnetic core.

In addition, a Fe-based soft magnetic alloy is used as a soft magnetic alloy to be contained in a magnetic core of a magnetic element. It is desired that a Fe-based soft magnetic alloy exhibits favorable soft magnetic properties (high saturation magnetic flux density and low coercivity).

Furthermore, it is also desired that a Fe-based soft magnetic alloy has a low melting point. This is because the manufacturing cost can be more cut down as the melting point of a Fe-based soft magnetic alloy is lower. The reason why the manufacturing cost can be more cut down as the melting point is lower is because the life time of materials such as refractories to be used in the manufacturing process is prolonged and more inexpensive ones can be used as the refractories themselves.

Patent document 1 describes an invention of an iron-based amorphous alloy containing Fe, Si, B, C and P and the like.

[Patent document 1] JP 2002-285305 A

SUMMARY

An object of the present invention is to provide a soft magnetic alloy having a low melting point, a low coercivity and a high saturation magnetic flux density at the same time and the like.

In order to attain the above object, the soft magnetic alloy according to the present invention contains a main component having a composition formula of $(Fe_{(1-(\alpha+\beta))}X1_{\alpha}X2_{\beta})_{(1-(a+b+c+d))}M_aB_bP_cC_d$ and auxiliary components including at least Ti, Mn and Al, in which X1 is one or more selected from the group consisting of Co and Ni, X2 is one or more selected from the group consisting of Ag, Zn, Sn, As, Sb, Bi and a rare earth element, M is one or more selected from the group consisting of Nb, Hf, Zr, Ta, Mo, W and V, $0.030 \le a \le 0.100$ $0.050 \le b \le 0.150$ $0 < c \le 0.030$ $0 < d \le 0.030$ $\alpha \ge 0$ $\beta \ge 0$ $0 \le \alpha+\beta \le 0.50$, and a content of Ti is 0.001 to 0.100 wt %, a content of Mn is 0.001 to 0.150 wt %, and a content of Al is 0.001 to 0.100 wt % with respect to 100 wt % of the entire soft magnetic alloy.

The soft magnetic alloy according to the present invention is likely to have a structure to be likely to form a Fe-based nanocrystalline alloy by a heat treatment as it has the features described above. Furthermore, the Fe-based nanocrystalline alloy having the features described above is a soft magnetic alloy having a low melting point, a low coercivity and a high saturation magnetic flux density at the same time.

In the soft magnetic alloy according to the present invention, $0.730 \le 1-(a+b+c+d) \le 0.918$ may be satisfied.

In the soft magnetic alloy according to the present invention, $0 \le \alpha\{1-(a+b+c+d)\} \le 0.40$ may be satisfied.

In the soft magnetic alloy according to the present invention, $\alpha=0$ may be satisfied.

In the soft magnetic alloy according to the present invention, $0 \le \beta\{1-(a+b+c+d)\} \le 0.030$ may be satisfied.

In the soft magnetic alloy according to the present invention, $\beta=0$ may be satisfied.

In the soft magnetic alloy according to the present invention, $\alpha=\beta=0$ may be satisfied.

The soft magnetic alloy according to the present invention may include an amorphous phase and an initial fine crystal and have a nanohetero structure in which the initial fine crystal is present in the amorphous phase.

In the soft magnetic alloy according to the present invention, an average grain size of the initial fine crystals may be 0.3 to 10 nm.

The soft magnetic alloy according to the present invention may have a structure containing a Fe-based nanocrystal.

In the soft magnetic alloy according to the present invention, an average grain size of the Fe-based nanocrystals may be 5 to 30 nm.

The soft magnetic alloy according to the present invention may be formed in a ribbon shape.

The soft magnetic alloy according to the present invention may be formed in a powder shape.

The magnetic device according to the present invention includes the soft magnetic alloy described above.

DETAILED DESCRIPTION

Hereinafter, embodiments of the present invention will be described.

The soft magnetic alloy according to the present embodiment is a soft magnetic alloy containing a main component having a composition formula of $(Fe_{(1-(\alpha+\beta))}X1_{\alpha}X2_{\beta})_{(1-(a+b+c+d))}M_aB_bP_cC_d$ and auxiliary components including at least Ti, Mn and Al, in which X1 is one or more selected from the group consisting of Co and Ni, X2 is one or more selected from the group consisting of Ag, Zn, Sn, As, Sb, Bi and a rare earth element, M is one or more selected from the group consisting of Nb, Hf, Zr, Ta, Mo, W and V, $0.030 \le a \le 0.100$ $0.050 \le b \le 0.150$ $0 < c \le 0.030$ $0<d\leq0.030$ $\alpha\geq0$ $\beta\geq0$ $0\leq\alpha+\beta\leq0.50$, and a content of Ti is 0.001 to 0.100 wt %, a content of Mn is 0.001 to 0.150 wt %, and a content of Al is 0.001 to 0.100 wt % with respect to 100 wt % of the entire soft magnetic alloy.

The soft magnetic alloy having the composition described above is likely to be a soft magnetic alloy which is composed of an amorphous phase and does not include a crystal phase composed of crystals having a grain size larger than 30 nm. Moreover, the Fe-based nanocrystals are likely to be deposited in the case of subjecting the soft magnetic alloy to a heat treatment. Moreover, the soft magnetic alloy containing Fe-based nanocrystals is likely to exhibit favorable magnetic properties.

In other words, the soft magnetic alloy having the composition described above is likely to be a starting material of the soft magnetic alloy on which Fe-based nanocrystals are deposited.

The Fe-based nanocrystal is a crystal which has a grain size of nano-order and in which the crystal structure of Fe is bcc (body-centered cubic structure). In the present embodiment, it is preferable to deposit Fe-based nanocrystals having an average grain size of 5 to 30 nm. A soft magnetic alloy on which such Fe-based nanocrystals are deposited is likely to have a high saturation magnetic flux density and a low coercivity. Furthermore, the soft magnetic alloy is likely to have a melting point lower than that of a soft magnetic alloy including the crystal phase composed of crystals having a grain size larger than 30 nm.

Note that, the soft magnetic alloy before being subjected to a heat treatment may be completely composed only of an amorphous phase, but it is preferable that the soft magnetic alloy is composed of an amorphous phase and initial fine crystals having a grain size of 15 nm or less and has a nanohetero structure in which the initial fine crystals are present in the amorphous phase. The Fe-based nanocrystals are likely to be deposited at the time of the heat treatment as the soft magnetic alloy has a nanohetero structure in which the initial fine crystals are present in the amorphous phase. Note that, in the present embodiment, it is preferable that the initial fine crystals have an average grain size of 0.3 to 10 nm.

Hereinafter, the respective components of the soft magnetic alloy according to the present embodiment will be described in detail.

M is one or more selected from the group consisting of Nb, Hf, Zr, Ta, Mo, W and V.

The content (a) of M is $0.030\leq a\leq0.100$. It is preferably $0.050\leq a\leq0.080$ and more preferably $0.050\leq a\leq0.070$. By setting the content (a) of M to $0.050\leq a\leq0.080$, particularly the melting point is likely to be decreased. By setting the content (a) of M to $0.050\leq a\leq0.070$, particularly the melting point and the coercivity are likely to be decreased. A crystal phase composed of crystals having a grain size larger than 30 nm is likely to be formed in the soft magnetic alloy before being subjected to a heat treatment in a case in which (a) is too small, and it is impossible to deposit Fe-based nanocrystals by a heat treatment and the melting point and the coercivity are likely to increase in a case in which a crystal phase is formed. The saturation magnetic flux density is likely to decrease in a case in which (a) is too large.

The content (b) of B is $0.050\leq b\leq0.150$. It is preferably $0.080\leq b\leq0.120$. By setting the content (b) of B to $0.080\leq b\leq0.120$, particularly the coercivity is likely to be decreased. The coercivity is likely to increase in a case in which (b) is too small. The saturation magnetic flux density is likely to decrease in a case in which (b) is too large.

The content (c) of P is $0<c\leq0.030$. It is preferably $0.001\leq c\leq0.030$, more preferably $0.003\leq c\leq0.030$, and most preferably $0.003\leq c\leq0.015$. By setting the content (c) of P to $0.003\leq c\leq0.030$, particularly the melting point is likely to be decreased. By setting the content (c) of P to $0.003\leq c\leq0.015$, particularly the melting point and the coercivity are likely to be decreased. The melting point and the coercivity are likely to increase in a case in which (c) is too small. The coercivity is likely to increase and the saturation magnetic flux density is likely to decrease in a case in which (c) is too large.

The content (d) of C satisfies $0<d\leq0.030$. It is preferably $0.001\leq d\leq0.030$, more preferably $0.003\leq d\leq0.030$, and most preferably $0.003\leq d\leq0.015$. By setting the content (d) of C to $0.003\leq d\leq0.030$, particularly the melting point is likely to be decreased. By setting the content (d) of C to $0.003\leq d\leq0.015$, particularly the melting point and the coercivity are likely to be decreased. The melting point and the coercivity are likely to increase in a case in which (d) is too small. The coercivity is likely to increase and the saturation magnetic flux density is likely to decrease in a case in which (d) is too large.

The content $(1-(a+b+c+d))$ of Fe may be an arbitrary value. In addition, it is preferably $0.730\leq1-(a+b+c+d)\leq0.918$ and more preferably $0.810\leq1-(a+b+c+d)\leq0.850$. By setting $(1-(a+b+c+d))$ to 0.730 or more, the saturation magnetic flux density is likely to increase. In addition, by setting $0.810\leq1-(a+b+c+d)\leq0.850$, particularly the melting point and the coercivity are likely to decrease and the saturation magnetic flux density is likely to increase.

Furthermore, the soft magnetic alloy according to the present embodiment contains Ti, Mn and Al as auxiliary components in addition to the main component described above. The content of Ti is 0.001 to 0.100 wt %, the content of Mn is 0.001 to 0.150 wt %, and the content of Al is 0.001 to 0.100 wt % with respect to 100 wt % of the entire soft magnetic alloy.

As all of Ti, Mn and Al are present in the trace amounts described above, it is possible to obtain a soft magnetic alloy having a low melting point, a low coercivity and a high saturation magnetic flux density at the same time. The effect described above is exerted by containing all of Ti, Mn and Al at the same time. The melting point and the coercivity are likely to increase in a case in which one or more of Ti, Mn or Al are not contained. In addition, the saturation magnetic flux density is likely to decrease in a case in which the contents of any one or more of Ti, Mn or Al exceed the above ranges.

The content of Ti is preferably 0.005 wt % or more and 0.080 wt % or less. The content of Mn is preferably 0.005 wt % or more and 0.150 wt % or less. The content of Al is preferably 0.005 wt % or more and 0.080 wt % or less. By setting the contents of Ti, Mn and/or Al to be in the above ranges, particularly the melting point and the coercivity are likely to decrease.

In addition, in the soft magnetic alloy according to the present embodiment, a part of Fe may be substituted with X1 and/or X2.

X1 is one or more selected from the group consisting of Co and Ni. With regard to the content of X1, $\beta=0$ may be satisfied. In other words, X1 may not be contained. In addition, the number of atoms of X1 is preferably 40 at % or less with respect to 100 at % of the number of atoms of the entire composition. In other words, it is preferable that $0\leq\alpha\{1-(a+b+c+d)\}\leq0.40$ is satisfied.

X2 is one or more selected from the group consisting of Ag, Zn, Sn, As, Sb, Bi and a rare earth element. With regard to the content of X2, $\beta=0$ may be satisfied. In other words, X2 may not be contained. In addition, the number of atoms of X2 is preferably 3.0 at % or less with respect to 100 at % of the number of atoms of the entire composition. In other words, it is preferable that $0 \leq \beta\{1-(a+b+c+d)\} \leq 0.030$ is satisfied.

The range of the substitution amount in which Fe is substituted with X1 and/or X2 is set to a half or less of Fe based on the number of atoms. In other words, the range is set to $0 \leq \alpha+\beta \leq 0.50$. In the case of $\alpha+\beta>0.50$, it is difficult to form a Fe-based nanocrystalline alloy by a heat treatment.

Note that the soft magnetic alloy according to the present embodiment may contain elements (for example, Si, Cu, and the like) other than those described above as inevitable impurities. For example, the elements may be contained at 0.1 wt % or less with respect to 100 wt % of the soft magnetic alloy. Particularly in the case of containing Si, it is more preferable as the content of Si is lower since a crystal phase composed of crystals having a grain size larger than 30 nm is likely to be formed. Particularly in the case of containing Cu, it is more preferable as the content of Cu is lower since the saturation magnetic flux density is likely to decrease.

Hereinafter, a method of producing the soft magnetic alloy according to the present embodiment will be described.

The method of producing the soft magnetic alloy according to the present embodiment is not particularly limited. For example, there is a method in which a ribbon of the soft magnetic alloy according to the present embodiment is produced by a single roll method. In addition, the ribbon may be a continuous ribbon.

In the single roll method, first, pure metals of the respective metal elements to be contained in the soft magnetic alloy to be finally obtained are prepared and weighed so as to have the same composition as that of the soft magnetic alloy to be finally obtained. Thereafter, the pure metals of the respective metal elements are melted and mixed together to prepare a base alloy. Note that the method of melting the pure metals is not particularly limited, but for example, there is a method in which interior of the chamber is vacuumed and then the pure metals are melted in the chamber by high frequency heating. Note that the base alloy and the soft magnetic alloy, which is finally obtained and composed of Fe-based nanocrystals, usually have the same composition as each other.

Next, the prepared base alloy is heated and melted to obtain a molten metal (melt). The temperature of the molten metal is not particularly limited, but it may be, for example, 1200° C. to 1500° C.

In the single roll method, it is possible to adjust the thickness of the ribbon to be obtained mainly by adjusting the rotating speed of a roll, but it is also possible to adjust the thickness of the ribbon to be obtained by adjusting, for example, the distance between the nozzle and the roll and the temperature of the molten metal. The thickness of the ribbon is not particularly limited, but it may be, for example, 5 to 30 μm.

At the time point before a heat treatment to be described later is performed, the ribbon is amorphous as it does not contain a crystal having a grain size larger than 30 nm. The Fe-based nanocrystalline alloy can be obtained by subjecting the amorphous ribbon to a heat treatment to be described later.

Note that the method of confirming whether or not the ribbon of a soft magnetic alloy before being subjected to a heat treatment contains a crystal having a grain size larger than 30 nm is not particularly limited. For example, the presence or absence of a crystal having a grain size larger than 30 nm can be confirmed by usual X-ray diffraction measurement.

In addition, the ribbon before being subjected to a heat treatment may not contain the initial fine crystal having a grain size of 15 nm or less, but it is preferable to contain the initial fine crystals. In other words, it is preferable that the ribbon before being subjected to a heat treatment has a nanohetero structure composed of an amorphous phase and the initial fine crystal present in the amorphous phase. Note that the grain size of the initial fine crystals is not particularly limited, but it is preferable that the average grain size thereof is in a range of 0.3 to 10 nm.

In addition, the methods of observing the presence or absence and average grain size of the initial fine crystals are not particularly limited, but for example, the presence or absence and average grain size of the initial fine crystals can be confirmed by obtaining a selected area diffraction image, a nano beam diffraction image, a bright field image or a high resolution image of a sample thinned by ion milling by using a transmission electron microscope. In the case of using a selected area diffraction image or a nano beam diffraction image, a ring-shaped diffraction is formed in a case in which the initial fine crystals are amorphous but diffraction spots due to the crystal structure are formed in a case in which the initial fine crystals are not amorphous in the diffraction pattern. In addition, in the case of using a bright field image or a high resolution image, the presence or absence and average grain size of the initial fine crystals can be confirmed by visual observation at a magnification of $1.00\times10^5$ to $3.00\times10^5$.

The temperature and rotating speed of the roll and the internal atmosphere of the chamber are not particularly limited. It is preferable to set the temperature of the roll to 4° C. to 30° C. for amorphization. The average grain size of the initial fine crystals tends to be smaller as the rotating speed of the roll is faster, and it is preferable to set the rotating speed to 30 to 40 m/sec in order to obtain initial fine crystals having an average grain size of 0.3 to 10 nm. The internal atmosphere of the chamber is preferably set to air atmosphere in consideration of cost.

In addition, the heat treatment conditions for producing the Fe-based nanocrystalline alloy are not particularly limited. Preferable heat treatment conditions differ depending on the composition of the soft magnetic alloy. Usually, the preferable heat treatment temperature is approximately 450° C. to 600° C. and the preferable heat treatment time is approximately 0.5 to 10 hours. However, there is also a case in which the preferable heat treatment temperature and heat treatment time exist in ranges deviated from the above ranges depending on the composition. In addition, the atmosphere at the time of the heat treatment is not particularly limited. The heat treatment may be performed in an active atmosphere such as air atmosphere or in an inert atmosphere such as Ar gas.

In addition, the method of calculating the average grain size of the Fe-based nanocrystalline alloy obtained is not particularly limited. For example, it can be calculated by observing the Fe-based nanocrystalline alloy under a transmission electron microscope. In addition, the method of confirming that the crystal structure is bcc (body-centered cubic structure) is also not particularly limited. For example, the crystal structure can be confirmed by X-ray diffraction measurement.

In addition, as a method of obtaining the soft magnetic alloy according to the present embodiment, for example, there is a method in which a powder of the soft magnetic alloy according to the present embodiment is obtained by a water atomizing method or a gas atomizing method other than the single roll method described above. The gas atomizing method will be described below.

In the gas atomizing method, a molten alloy at 1200° C. to 1500° C. is obtained in the same manner as in the single roll method described above. Thereafter, the molten alloy is sprayed into the chamber and a powder is prepared.

At this time, it is likely to obtain the preferable nanohetero structure described above by setting the gas spraying temperature to 4° C. to 30° C. and the vapor pressure in the chamber to 1 hPa or less.

By performing the heat treatment at a heat treatment temperature of 400° C. to 600° C. for 0.5 to 10 minutes after the powder has been prepared by the gas atomizing method, it is possible to promote the diffusion of elements while preventing the powders from being coarsened by sintering of the respective powders, to achieve the thermodynamical equilibrium state in a short time, and to remove distortion and stress and it is likely to obtain a Fe-based soft magnetic alloy having an average grain size of 10 to 50 nm.

An embodiment of the present invention has been described above, but the present invention is not limited to the above embodiment.

The shape of the soft magnetic alloy according to the present embodiment is not particularly limited. As described above, examples thereof may include a ribbon shape and a powder shape, but a block form and the like are also conceivable other than these.

The application of the soft magnetic alloy (Fe-based nanocrystalline alloy) according to the present embodiment is not particularly limited. For example, magnetic devices are mentioned, and particularly magnetic cores are mentioned among these. The soft magnetic alloy can be suitably used as a magnetic core for an inductor, particularly for a power inductor. The soft magnetic alloy according to the present embodiment can also be suitably used in thin film inductors and magnetic heads in addition to the magnetic cores.

Hereinafter, a method of obtaining a magnetic device, particularly a magnetic core and an inductor from the soft magnetic alloy according to the present embodiment will be described, but the method of obtaining a magnetic core and an inductor from the soft magnetic alloy according to the present embodiment is not limited to the following method. Further, examples of the application of the magnetic core may include transformers and motors in addition to the inductors.

Examples of a method of obtaining a magnetic core from a soft magnetic alloy in a ribbon shape may include a method in which the soft magnetic alloy of the ribbon shape is wound and a method in which the soft magnetic alloy of the ribbon shape is laminated. It is possible to obtain a magnetic core exhibiting further improved properties in the case of laminating the soft magnetic alloy of the ribbon shape via an insulator.

Examples of a method of obtaining a magnetic core from a powdery soft magnetic alloy may include a method in which the powdery soft magnetic alloy is appropriately mixed with a binder and then molded by using a press mold. In addition, the specific resistance is improved and a magnetic core adapted to a higher frequency band is obtained by subjecting the powder surface to an oxidation treatment, an insulating coating, and the like before the powdery soft magnetic alloy is mixed with a binder.

The molding method is not particularly limited, and examples thereof may include molding using a press mold or mold molding. The kind of binder is not particularly limited, and examples thereof may include a silicone resin. The mixing ratio of a binder to the soft magnetic alloy powder is also not particularly limited. For example, a binder is mixed at 1 to 10 mass % with respect to 100 mass % of the soft magnetic alloy powder.

It is possible to obtain a magnetic core having a space factor (powder filling rate) of 70% or more, a magnetic flux density of 0.45 T or more when a magnetic field of $1.6\times10^4$ A/m is applied, and a specific resistance of 1 Ω·cm or more, for example, by mixing a binder at 1 to 5 mass % with respect to 100 mass % of the soft magnetic alloy powder and performing compression molding of the mixture using a press mold. The above properties are equal or superior to those of a general ferrite core.

In addition, it is possible to obtain a dust core having a space factor of 80% or more, a magnetic flux density of 0.9 T or more when a magnetic field of $1.6\times10^4$ A/m is applied, and a specific resistance of 0.1 Ω·cm or more, for example, by mixing a binder at 1 to 3 mass % with respect to 100 mass % of the soft magnetic alloy powder and performing compression molding of the mixture using a press mold under a temperature condition of the softening point of the binder or more. The above properties are superior to those of a general dust core.

The core loss further decreases and the usability increases by further subjecting the green compact forming the magnetic core to a heat treatment as a distortion relief heat treatment after the green compact is molded. Note that, the core loss of the magnetic core decreases as the coercivity of the magnetic material constituting the magnetic core decreases.

In addition, an inductance component is obtained by subjecting the magnetic core to winding. The method of winding and the method of producing an inductance component are not particularly limited. For example, there is a method in which a coil is wound around the magnetic core produced by the method described above one or more turns.

Furthermore, in the case of using soft magnetic alloy grains, there is a method in which an inductance component is produced by compression-molding and integrating the magnetic material and the winding coil in a state in which the winding coil is incorporated in the magnetic material. In this case, it is easy to obtain an inductance component responding to a high frequency and a large current.

Furthermore, in the case of using soft magnetic alloy grains, it is possible to obtain an inductance component by alternately printing and laminating a soft magnetic alloy paste prepared by adding a binder and a solvent to soft magnetic alloy grains and pasting the mixture and a conductive paste prepared by adding a binder and a solvent to a conductive metal for a coil and pasting the mixture and then heating and firing the laminate. Alternatively, it is possible to obtain an inductance component in which a coil is incorporated in the magnetic material by preparing a soft magnetic alloy sheet using a soft magnetic alloy paste, printing a conductive paste on the surface of the soft magnetic alloy sheet, and laminating and firing these.

Here, in the case of producing an inductance component using soft magnetic alloy grains, it is preferable to use a soft magnetic alloy powder having a maximum grain size of 45

μm or less in terms of sieve size and a center grain size (D50) of 30 μm or less in order to obtain excellent Q properties. A sieve having a mesh size of 45 μm may be used and only the soft magnetic alloy powder passing through the sieve may be used in order to set the maximum grain size to 45 μm or less in terms of the sieve size.

The Q value tends to decrease in the high frequency region as the soft magnetic alloy powder having a larger maximum grain size is used, and there is a case in which the Q value in the high frequency region greatly decreases particularly in the case of using a soft magnetic alloy powder having a maximum grain size of more than 45 μm in terms of the sieve size. However, it is possible to use a soft magnetic alloy powder having a large deviation in a case in which the Q value in the high frequency region is not regarded as important. It is possible to cut down the cost in a case in which a soft magnetic alloy powder having a large deviation is used since the soft magnetic alloy powder having a large deviation can be produced at relatively low cost.

EXAMPLES

Hereinafter, the present invention will be specifically described based on Examples.

Metal materials were weighed so as to obtain the alloy compositions of the respective Examples and Comparative Examples presented in the following table, and melted by high frequency heating, thereby preparing a base alloy.

Thereafter, the prepared base alloy was heated and melted to obtain a metal at 1300° C. in a molten state, and then the metal was sprayed to a roll at 20° C. at a rotating speed of 30 m/sec in the air atmosphere by a single roll method, thereby preparing a ribbon. The thickness of the ribbon was set to 20 to 25 μm, the width of the ribbon was set to about 15 mm, and the length of the ribbon was set to about 10 m.

The respective ribbons thus obtained were subjected to the X-ray diffraction measurement to confirm the presence or absence of crystals having a grain size larger than 30 nm. Thereafter, the ribbon was determined to be composed of an amorphous phase in a case in which a crystal having a grain size larger than 30 nm is not present and the ribbon was determined to be composed of a crystal phase in a case in which a crystal having a grain size larger than 30 nm is present. Note that the amorphous phase may contain initial fine crystals having a grain size of 15 nm or less.

Thereafter, the ribbons of the respective Examples and Comparative Examples were subjected to a heat treatment under the conditions presented in the following tables. Note that the heat treatment temperature was set to 550° C. in the case of the samples of which the heat treatment temperature was not presented in the following tables. The melting point, coercivity, and saturation magnetic flux density of the respective ribbons after being subjected to the heat treatment were measured. The melting point was measured by using a differential scanning calorimeter (DSC). The coercivity (Hc) was measured at a magnetic field of 5 kA/m by using a direct current BH tracer. The saturation magnetic flux density (Bs) was measured at a magnetic field of 1000 kA/m by using a vibrating sample magnetometer (VSM). In the present Example, a melting point of 1170° C. or less was determined to be favorable and a melting point of 1150° C. or less was determined to be more favorable. A coercivity of 2.0 A/m or less was determined to be favorable and a coercivity of less than 1.5 A/m was determined to be more favorable. A saturation magnetic flux density of 1.30 T or more was determined to be favorable and a saturation magnetic flux density of 1.35 T or more was determined to be more favorable.

Note that, in the following Examples, it was confirmed that Fe-based nanocrystals having an average grain size of 5 to 30 nm and a bcc crystal structure were contained by the X-ray diffraction measurement and the observation under a transmission electron microscope unless otherwise stated.

TABLE 1

| | $(Fe_{(1-(a+b+c+d))}M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Comparative Example 1 | 0.862 | ***0.028*** | 0.100 | 0.005 | 0.005 | 0.010 | 0.010 | 0.010 | Crystal phase | ***1173*** | ***283*** | 1.62 |
| Example 1 | 0.860 | 0.030 | 0.100 | 0.005 | 0.005 | 0.010 | 0.010 | 0.010 | Amorphous phase | 1163 | 1.8 | 1.62 |
| Example 2 | 0.850 | 0.040 | 0.100 | 0.005 | 0.005 | 0.010 | 0.010 | 0.010 | Amorphous phase | 1154 | 1.6 | 1.55 |
| Example 3 | 0.840 | 0.050 | 0.100 | 0.005 | 0.005 | 0.010 | 0.010 | 0.010 | Amorphous phase | 1146 | 1.3 | 1.52 |
| Example 4 | 0.830 | 0.060 | 0.100 | 0.005 | 0.005 | 0.010 | 0.010 | 0.010 | Amorphous phase | 1137 | 1.2 | 1.46 |
| Example 5 | 0.820 | 0.070 | 0.100 | 0.005 | 0.005 | 0.010 | 0.010 | 0.010 | Amorphous phase | 1132 | 1.3 | 1.43 |
| Example 6 | 0.810 | 0.080 | 0.100 | 0.005 | 0.005 | 0.010 | 0.010 | 0.010 | Amorphous phase | 1144 | 1.7 | 1.40 |
| Example 7 | 0.790 | 0.100 | 0.100 | 0.005 | 0.005 | 0.010 | 0.010 | 0.010 | Amorphous phase | 1151 | 1.8 | 1.42 |
| Comparative Example 2 | 0.780 | ***0.110*** | 0.100 | 0.005 | 0.005 | 0.010 | 0.010 | 0.010 | Amorphous phase | 1155 | 1.9 | ***1.27*** |

TABLE 2

| | $(Fe_{(1-(a+b+c+d))}M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Comparative Example 3 | 0.885 | 0.060 | ***0.045*** | 0.005 | 0.005 | 0.010 | 0.010 | 0.010 | Crystal phase | 1132 | ***2.7*** | 1.66 |
| Example 11 | 0.880 | 0.060 | 0.050 | 0.005 | 0.005 | 0.010 | 0.010 | 0.010 | Amorphous phase | 1133 | 1.9 | 1.65 |
| Example 12 | 0.860 | 0.060 | 0.070 | 0.005 | 0.005 | 0.010 | 0.010 | 0.010 | Amorphous phase | 1135 | 1.6 | 1.60 |

TABLE 2-continued

| | $(Fe_{(1(a+b+c+d)})M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Example 13 | 0.850 | 0.060 | 0.080 | 0.005 | 0.005 | 0.010 | 0.010 | 0.010 | Amorphous phase | 1137 | 1.3 | 1.57 |
| Example 4 | 0.830 | 0.060 | 0.100 | 0.005 | 0.005 | 0.010 | 0.010 | 0.010 | Amorphous phase | 1137 | 1.2 | 1.46 |
| Example 15 | 0.810 | 0.060 | 0.120 | 0.005 | 0.005 | 0.010 | 0.010 | 0.010 | Amorphous phase | 1138 | 1.3 | 1.46 |
| Example 15 | 0.800 | 0.060 | 0.130 | 0.005 | 0.005 | 0.010 | 0.010 | 0.010 | Amorphous phase | 1141 | 1.5 | 1.45 |
| Example 16 | 0.780 | 0.060 | 0.150 | 0.005 | 0.005 | 0.010 | 0.010 | 0.010 | Amorphous phase | 1144 | 1.7 | 1.41 |
| Comparative Example 4 | 0.770 | 0.060 | ***0.160*** | 0.005 | 0.005 | 0.010 | 0.010 | 0.010 | Amorphous phase | 1145 | 1.8 | ***1.29*** |

TABLE 3

| | $(Fe_{(1(a+b+c+d)})M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Comparative Example 5 | 0.840 | 0.060 | 0.100 | ***0.000*** | ***0.000*** | 0.010 | 0.010 | 0.010 | Amorphous phase | ***1189*** | ***7.2*** | 1.42 |
| Comparative Example 6 | 0.835 | 0.060 | 0.100 | ***0.000*** | 0.005 | 0.010 | 0.010 | 0.010 | Amorphous phase | ***1184*** | 6.2 | 1.44 |
| Example 21 | 0.834 | 0.060 | 0.100 | 0.001 | 0.005 | 0.010 | 0.010 | 0.010 | Amorphous phase | 1168 | 1.9 | 1.57 |
| Example 22 | 0.832 | 0.060 | 0.100 | 0.003 | 0.005 | 0.010 | 0.010 | 0.010 | Amorphous phase | 1146 | 1.3 | 1.55 |
| Example 4 | 0.830 | 0.060 | 0.100 | 0.005 | 0.005 | 0.010 | 0.010 | 0.010 | Amorphous phase | 1137 | 1.2 | 1.46 |
| Example 23 | 0.828 | 0.060 | 0.100 | 0.007 | 0.005 | 0.010 | 0.010 | 0.010 | Amorphous phase | 1135 | 1.3 | 1.45 |
| Example 24 | 0.825 | 0.060 | 0.100 | 0.010 | 0.005 | 0.010 | 0.010 | 0.010 | Amorphous phase | 1130 | 1.3 | 1.43 |
| Example 25 | 0.820 | 0.060 | 0.100 | 0.015 | 0.005 | 0.010 | 0.010 | 0.010 | Amorphous phase | 1122 | 1.3 | 1.43 |
| Example 26 | 0.815 | 0.060 | 0.100 | 0.020 | 0.005 | 0.010 | 0.010 | 0.010 | Amorphous phase | 1117 | 1.7 | 1.40 |
| Example 27 | 0.805 | 0.060 | 0.100 | 0.030 | 0.005 | 0.010 | 0.010 | 0.010 | Amorphous phase | 1109 | 1.8 | 1.38 |
| Comparative Example 7 | 0.800 | 0.060 | 0.100 | ***0.035*** | 0.005 | 0.010 | 0.010 | 0.010 | Amorphous phase | 1105 | ***5.0*** | ***1.25*** |

TABLE 4

| | $(Fe_{(1(a+b+c+d)})M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Comparative Example 5 | 0.840 | 0.060 | 0.100 | ***0.000*** | ***0.000*** | 0.010 | 0.010 | 0.010 | Crystal phase | ***1189*** | ***7.2*** | 1.42 |
| Comparative Example 8 | 0.835 | 0.060 | 0.100 | 0.005 | ***0.000*** | 0.010 | 0.010 | 0.010 | Crystal phase | ***1180*** | ***5.9*** | 1.45 |
| Example 31 | 0.834 | 0.060 | 0.100 | 0.005 | 0.001 | 0.010 | 0.010 | 0.010 | Amorphous phase | 1159 | 1.7 | 1.55 |
| Example 32 | 0.832 | 0.060 | 0.100 | 0.005 | 0.003 | 0.010 | 0.010 | 0.010 | Amorphous phase | 1142 | 1.3 | 1.50 |
| Example 4 | 0.830 | 0.060 | 0.100 | 0.005 | 0.005 | 0.010 | 0.010 | 0.010 | Amorphous phase | 1137 | 1.2 | 1.46 |
| Example 33 | 0.828 | 0.060 | 0.100 | 0.005 | 0.007 | 0.010 | 0.010 | 0.010 | Amorphous phase | 1133 | 1.3 | 1.47 |
| Example 34 | 0.825 | 0.060 | 0.100 | 0.005 | 0.010 | 0.010 | 0.010 | 0.010 | Amorphous phase | 1130 | 1.3 | 1.44 |
| Example 35 | 0.820 | 0.060 | 0.100 | 0.005 | 0.015 | 0.010 | 0.010 | 0.010 | Amorphous phase | 1126 | 1.3 | 1.41 |
| Example 36 | 0.815 | 0.060 | 0.100 | 0.005 | 0.020 | 0.010 | 0.010 | 0.010 | Amorphous phase | 1121 | 1.6 | 1.39 |
| Example 37 | 0.805 | 0.060 | 0.100 | 0.005 | 0.030 | 0.010 | 0.010 | 0.010 | Amorphous phase | 1115 | 1.8 | 1.37 |
| Comparative Example 9 | 0.800 | 0.060 | 0.100 | 0.005 | ***0.035*** | 0.010 | 0.010 | 0.010 | Amorphous phase | 1109 | ***5.1*** | ***1.28*** |

TABLE 5

| | $(Fe_{(1(a+b+c+d)})M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Example 38 | 0.918 | 0.030 | 0.050 | 0.001 | 0.001 | 0.010 | 0.010 | 0.010 | Amorphous phase | 1168 | 1.9 | 1.67 |
| Example 32 | 0.850 | 0.060 | 0.080 | 0.005 | 0.005 | 0.010 | 0.010 | 0.010 | Amorphous phase | 1137 | 1.3 | 1.57 |

TABLE 5-continued

| | $(Fe_{(1(a+b+c+d)})M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Example 4 | 0.830 | 0.060 | 0.100 | 0.005 | 0.005 | 0.010 | 0.010 | 0.010 | Amorphous phase | 1137 | 1.2 | 1.46 |
| Example 14 | 0.810 | 0.060 | 0.120 | 0.005 | 0.005 | 0.010 | 0.010 | 0.010 | Amorphous phase | 1138 | 1.3 | 1.46 |
| Example 39 | 0.730 | 0.100 | 0.130 | 0.020 | 0.020 | 0.010 | 0.010 | 0.010 | Amorphous phase | 1125 | 1.8 | 1.35 |
| Example 40 | 0.690 | 0.100 | 0.150 | 0.030 | 0.030 | 0.010 | 0.010 | 0.010 | Amorphous phase | 1111 | 2.0 | 1.31 |

TABLE 6

| | $(Fe_{(1(a+b+c+d)})M_aB_bP_cC_d$ ($\alpha = \beta = 0$) | | | | | | | | | | | |
|---|---|---|---|---|---|---|---|---|---|---|---|---|
| | Main Component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Example 41 | 0.830 | 0.060 | 0.100 | 0.005 | 0.005 | 0.001 | 0.001 | 0.001 | Amorphous phase | 1148 | 1.3 | 1.46 |
| Example 4 | 0.830 | 0.060 | 0.100 | 0.005 | 0.005 | 0.010 | 0.010 | 0.010 | Amorphous phase | 1137 | 1.2 | 1.46 |
| Example 42 | 0.830 | 0.060 | 0.100 | 0.005 | 0.005 | 0.080 | 0.100 | 0.080 | Amorphous phase | 1113 | 1.3 | 1.45 |
| Example 43 | 0.830 | 0.060 | 0.100 | 0.005 | 0.005 | 0.100 | 0.150 | 0.100 | Amorphous phase | 1110 | 1.5 | 1.42 |
| Comparative Example 11 | 0.830 | 0.060 | 0.100 | 0.005 | 0.005 | ***0.000*** | 0.010 | 0.010 | Amorphous phase | ***1176*** | 6.3 | 1.50 |
| Comparative Example 12 | 0.830 | 0.060 | 0.100 | 0.005 | 0.005 | 0.010 | 0.000 | 0.010 | Amorphous phase | ***1181*** | 5.6 | 1.46 |
| Comparative Example 13 | 0.830 | 0.060 | 0.100 | 0.005 | 0.005 | 0.010 | 0.010 | 0.000 | Amorphous phase | ***1175*** | 4.5 | 1.47 |
| Comparative Example 14 | 0.830 | 0.060 | 0.100 | 0.005 | 0.005 | 0.000 | 0.000 | 0.010 | Amorphous phase | 1182 | 4.9 | 1.49 |
| Comparative Example 15 | 0.830 | 0.060 | 0.100 | 0.005 | 0.005 | 0.000 | 0.010 | 0.000 | Amorphous phase | 1183 | 5.5 | 1.51 |
| Comparative Example 16 | 0.830 | 0.060 | 0.100 | 0.005 | 0.005 | 0.010 | 0.000 | 0.000 | Amorphous phase | 1181 | 6.1 | 1.54 |
| Comparative Example 17 | 0.830 | 0.060 | 0.100 | 0.005 | 0.005 | 0.000 | 0.000 | 0.000 | Amorphous phase | 1184 | 5.3 | 1.53 |

TABLE 7

| | $(Fe_{(1(a+b+c+d)})M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Comparative Example 11 | 0.830 | 0.060 | 0.100 | 0.005 | 0.005 | ***0.000*** | 0.010 | 0.010 | Crystal phase | ***1176*** | ***6.3*** | 1.50 |
| Example 51 | 0.830 | 0.060 | 0.100 | 0.005 | 0.005 | 0.001 | 0.010 | 0.010 | Amorphous phase | 1153 | 1.7 | 1.49 |
| Example 52 | 0.830 | 0.060 | 0.100 | 0.005 | 0.005 | 0.005 | 0.010 | 0.010 | Amorphous phase | 1140 | 1.3 | 1.48 |
| Example 4 | 0.830 | 0.060 | 0.100 | 0.005 | 0.005 | 0.010 | 0.010 | 0.010 | Amorphous phase | 1137 | 1.2 | 1.46 |
| Example 53 | 0.830 | 0.060 | 0.100 | 0.005 | 0.005 | 0.050 | 0.010 | 0.010 | Amorphous phase | 1133 | 1.3 | 1.45 |
| Example 54 | 0.830 | 0.060 | 0.100 | 0.005 | 0.005 | 0.080 | 0.010 | 0.010 | Amorphous phase | 1134 | 1.3 | 1.43 |
| Example 55 | 0.830 | 0.060 | 0.100 | 0.005 | 0.005 | 0.100 | 0.010 | 0.010 | Amorphous phase | 1151 | 1.6 | 1.42 |
| Comparative Example 18 | 0.830 | 0.060 | 0.100 | 0.005 | 0.005 | ***0.110*** | 0.010 | 0.010 | Amorphous phase | 1168 | 1.9 | ***1.28*** |

TABLE 8

| | $(Fe_{(1(a+b+c+d)})M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Comparative Example 12 | 0.830 | 0.060 | 0.100 | 0.005 | 0.005 | 0.010 | ***0.000*** | 0.010 | Crystal phase | ***1181*** | ***5.6*** | 1.46 |
| Example 61 | 0.830 | 0.060 | 0.100 | 0.005 | 0.005 | 0.010 | 0.001 | 0.010 | Amorphous phase | 1160 | 1.8 | 1.50 |
| Example 56 | 0.830 | 0.060 | 0.100 | 0.005 | 0.005 | 0.010 | 0.005 | 0.010 | Amorphous phase | 1143 | 1.3 | 1.48 |
| Example 4 | 0.830 | 0.060 | 0.100 | 0.005 | 0.005 | 0.010 | 0.010 | 0.010 | Amorphous phase | 1137 | 1.2 | 1.46 |

TABLE 8-continued

| | $(Fe_{(1(a+b+c+d))})M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | M = Nb a | B b | P c | C d | Ti (wt %) | Mn (wt %) | Al (wt %) | XRD | Melting point (° C.) | Hc (A/m) | Bs (T) |
| Example 63 | 0.830 | 0.060 | 0.100 | 0.005 | 0.005 | 0.010 | 0.050 | 0.010 | Amorphous phase | 1135 | 1.3 | 1.45 |
| Example 64 | 0.830 | 0.060 | 0.100 | 0.005 | 0.005 | 0.010 | 0.100 | 0.010 | Amorphous phase | 1145 | 1.3 | 1.43 |
| Example 65 | 0.830 | 0.060 | 0.100 | 0.005 | 0.005 | 0.010 | 0.150 | 0.010 | Amorphous phase | 1149 | 1.3 | 1.43 |
| Comparative Example 19 | 0.830 | 0.060 | 0.100 | 0.005 | 0.005 | 0.010 | ***0.160*** | 0.010 | Amorphous phase | 1157 | 1.9 | ***1.26*** |

TABLE 9

| | $(Fe_{(1(a+b+c+d))})M_aB_bP_cC_d$ ($\alpha = \beta = 0$) | | | | | | | | | | | |
|---|---|---|---|---|---|---|---|---|---|---|---|---|
| | Main component | | | | | Auxiliary component | | | | | | |
| Sample number | Fe | (M = Nb) a | B b | P c | C d | Ti (wt %) | Mn (wt %) | Al (wt %) | XRD | Melting point (° C.) | Hc (A/m) | Bs (T) |
| Comparative Example 13 | 0.830 | 0.060 | 0.100 | 0.005 | 0.005 | 0.010 | 0.010 | ***0.000*** | Amorphous phase | ***1175*** | ***4.5*** | 1.47 |
| Example 71 | 0.830 | 0.060 | 0.100 | 0.005 | 0.005 | 0.010 | 0.010 | 0.001 | Amorphous phase | 1155 | 1.7 | 1.50 |
| Example 72 | 0.830 | 0.060 | 0.100 | 0.005 | 0.005 | 0.010 | 0.010 | 0.005 | Amorphous phase | 1144 | 1.3 | 1.47 |
| Example 4 | 0.830 | 0.060 | 0.100 | 0.005 | 0.005 | 0.010 | 0.010 | 0.010 | Amorphous phase | 1137 | 1.2 | 1.46 |
| Example 73 | 0.830 | 0.060 | 0.100 | 0.005 | 0.005 | 0.010 | 0.010 | 0.050 | Amorphous phase | 1132 | 1.3 | 1.44 |
| Example 74 | 0.830 | 0.060 | 0.100 | 0.005 | 0.005 | 0.010 | 0.010 | 0.080 | Amorphous phase | 1126 | 1.3 | 1.41 |
| Example 75 | 0.830 | 0.060 | 0.100 | 0.005 | 0.005 | 0.010 | 0.010 | 0.100 | Amorphous phase | 1123 | 1.5 | 1.39 |
| Comparative Example 20 | 0.830 | 0.060 | 0.100 | 0.005 | 0.005 | 0.010 | 0.010 | ***0.110*** | Amorphous phase | 1119 | 1.7 | ***1.24*** |

TABLE 10

| | Conditions are the same as those in Example 4 except kind of M | | | | |
|---|---|---|---|---|---|
| Sample number | Kind of M | XRD | Melting point (° C.) | Hc | Bs |
| Example 4 | Nb | Amorphous phase | 1137 | 1.2 | 1.46 |
| Example 81 | Hf | Amorphous phase | 1138 | 1.3 | 1.47 |
| Example 82 | Zr | Amorphous phase | 1134 | 1.2 | 1.45 |
| Example 83 | Ta | Amorphous phase | 1143 | 1.3 | 1.45 |
| Example 84 | Mo | Amorphous phase | 1135 | 1.4 | 1.45 |
| Example 85 | W | Amorphous phase | 1140 | 1.4 | 1.44 |

TABLE 10-continued

| | Conditions are the same as those in Example 4 except kind of M | | | | |
|---|---|---|---|---|---|
| Sample number | Kind of M | XRD | Melting point (° C.) | Hc | Bs |
| Example 86 | V | Amorphous phase | 1139 | 1.3 | 1.44 |
| Example 87 | $Nb_{0.5}Hf_{0.5}$ | Amorphous phase | 1137 | 1.3 | 1.46 |
| Example 88 | $Zr_{0.5}Ta_{0.5}$ | Amorphous phase | 1139 | 1.3 | 1.46 |
| Example 89 | $Nb_{0.4}Hf_{0.3}Zr_{0.3}$ | Amorphous phase | 1135 | 1.4 | 1.45 |

TABLE 11

| | $Fe_{(1-(\alpha+\beta))}X1_{\alpha}X2_{\beta}$ (a to d and auxiliary omponents are the same as those in Example 4) | | | | | | | |
|---|---|---|---|---|---|---|---|---|
| | X1 | | X2 | | XRD | Melting point | Hc | Bs |
| Sample Number | Kind | $\alpha\{1-(a+b+c+d)\}$ | Kind | $\beta\{1-(a+b+c+d)\}$ | Amorphous phase | (° C.) | (A/m) | (T) |
| Example 4 | — | 0.000 | — | 0.000 | Amorphous phase | 1137 | 1.2 | 1.46 |
| Example 91 | Co | 0.010 | — | 0.000 | Amorphous phase | 1135 | 1.2 | 1.47 |
| Example 92 | Co | 0.100 | — | 0.000 | Amorphous phase | 1135 | 1.3 | 1.48 |
| Example 93 | Co | 0.400 | — | 0.000 | Amorphous phase | 1134 | 1.4 | 1.49 |
| Example 94 | Ni | 0.010 | — | 0.000 | Amorphous phase | 1138 | 1.3 | 1.46 |
| Example 95 | Ni | 0.100 | — | 0.000 | Amorphous phase | 1138 | 1.2 | 1.45 |
| Example 96 | Ni | 0.400 | — | 0.000 | Amorphous phase | 1140 | 1.2 | 1.43 |
| Example 97 | — | 0.000 | Zn | 0.030 | Amorphous phase | 1136 | 1.2 | 1.47 |
| Example 98 | — | 0.000 | Sn | 0.030 | Amorphous phase | 1137 | 1.3 | 1.46 |
| Example 99 | — | 0.000 | Sb | 0.030 | Amorphous phase | 1136 | 1.3 | 1.44 |
| Example 100 | — | 0.000 | Bi | 0.030 | Amorphous phase | 1134 | 1.3 | 1.45 |
| Example 101 | — | 0.000 | Y | 0.030 | Amorphous phase | 1135 | 1.2 | 1.46 |
| Example 102 | — | 0.000 | La | 0.030 | Amorphous phase | 1135 | 1.4 | 1.44 |
| Example 103 | Co | 0.100 | Zn | 0.030 | Amorphous phase | 1137 | 1.2 | 1.48 |

TABLE 12

| | a to d, α, β and auxiliary components are the same as those in Example 4 | | | | | | | |
|---|---|---|---|---|---|---|---|---|
| Sample number | Rotating speed of roll (m/sec) | Heat treatment temperature (° C.) | Average grain size of initial fine crystals (nm) | Average grain size of Fe-based nanocrystalline alloy (nm) | XRD | Melting point (° C.) | HC (A/m) | Bs (T) |
| Example 111 | 55 | 450 | No initial fine crystal | 3 | Amorphous phase | 1135 | 1.4 | 1.41 |
| Example 112 | 50 | 400 | 0.1 | 3 | Amorphous phase | 1136 | 1.4 | 1.41 |
| Example 113 | 40 | 450 | 0.3 | 5 | Amorphous phase | 1136 | 1.2 | 1.44 |
| Example 114 | 40 | 500 | 0.3 | 10 | Amorphous phase | 1136 | 1.3 | 1.45 |
| Example 115 | 40 | 550 | 0.3 | 13 | Amorphous phase | 1137 | 1.2 | 1.46 |
| Example 4 | 30 | 550 | 10.0 | 20 | Amorphous phase | 1137 | 1.2 | 1.46 |
| Example 116 | 30 | 600 | 10.0 | 30 | Amorphous phase | 1136 | 1.2 | 1.46 |
| Example 117 | 20 | 650 | 15.0 | 50 | Amorphous phase | 1137 | 1.4 | 1.47 |

Table 1 describes Examples and Comparative Examples in which only the content of Nb is changed while conditions other than the content of Nb are constantly maintained.

In Examples 1 to 7 in which the content (a) of Nb was in a range of $0.030 \leq a \leq 0.100$, the melting point, the coercivity and the saturation magnetic flux density were favorable. On the other hand, in Comparative Example 1 in which a=0.028 is satisfied, the ribbon before being subjected to a heat treatment was composed of a crystal phase and the coercivity after the heat treatment remarkably increased. In addition, the melting point also increased. In Comparative Example 2 in which a=0.110 is satisfied, the saturation magnetic flux density decreased.

Table 2 describes Examples and Comparative Examples in which only the content of B is changed while conditions other than the content (b) of B are the same.

In Examples 11 to 16 in which the content (b) of B was in a range of $0.050 \leq b \leq 0.150$, the melting point, the coercivity and the saturation magnetic flux density were favorable. On the other hand, in Comparative Example 3 in which b=0.045 is satisfied, the coercivity increased. In Comparative Example 4 in which a=0.160 is satisfied, the saturation magnetic flux density decreased.

Table 3 describes Examples and Comparative Examples in which the content of P is changed while conditions other than the content (c) of P are the same. In addition, Comparative Example in which both P and C are not contained is described together.

In Examples 21 to 27 in which $0 < c \leq 0.030$ is satisfied, the melting point, the coercivity and the saturation magnetic flux density were favorable. On the other hand, in Comparative Examples 5 and 6 in which c=0 is satisfied, the melting point and the coercivity increased. In Comparative Example 7 in which c=0.035 is satisfied, the coercivity increased and the saturation magnetic flux density decreased.

Table 4 describes Examples and Comparative Examples in which the content of C is changed while conditions other than the content (d) of C are the same. In addition, Comparative Example in which both P and C are not contained is described together.

In Examples 31 to 37 in which $0 < d \leq 0.030$ is satisfied, the melting point, the coercivity and the saturation magnetic flux density were favorable. On the other hand, in Comparative Examples 5 and 8 in which d=0 is satisfied, the melting point and the coercivity increased. In Comparative Example 9 in which d=0.035 is satisfied, the coercivity increased and the saturation magnetic flux density decreased.

Table 5 describes Example 38 in which the content (1−(a+b+c+d)) of Fe is increased by decreasing a, b, c and d at the same time and Examples 39 and 40 in which the content (1−(a+b+c+d)) of Fe is decreased by increasing a, b, c and d at the same time. In Examples 38 to 40, the melting point, the coercivity and the saturation magnetic flux density were favorable.

Table 6 describes Examples and Comparative Examples in which the content of the main component is constantly maintained but the contents of auxiliary components (Ti, Mn and Al) are changed.

In Examples 41 to 43 in which the contents of all the auxiliary components were in the ranges of the present invention, the melting point, the coercivity and the saturation magnetic flux density were favorable. On the other hand, in Comparative Examples 11 to 17 in which any one or more of Ti, Mn or Al were not contained, the melting point and the coercivity increased.

Table 7 describes Examples and Comparative Examples in which the content of Ti is changed while conditions other than the content of Ti are constantly maintained.

In Examples 51 to 55 in which the content of Ti was 0.001 to 0.100 wt %, the melting point, the coercivity and the saturation magnetic flux density were favorable. On the other hand, in Comparative Example 11 in which Ti was not contained, the melting point and the coercivity increased. In Comparative Example 18 in which the content of Ti was 0.110 wt %, the saturation magnetic flux density decreased.

Table 8 describes Examples and Comparative Examples in which the content of Mn is changed while conditions other than the content of Mn are constantly maintained.

In Examples 61 to 65 in which the content of Mn was 0.001 to 0.150 wt %, the melting point, the coercivity and the saturation magnetic flux density were favorable. On the other hand, in Comparative Example 12 in which Mn was not contained, the melting point and the coercivity increased. In Comparative Example 19 in which the content of Mn was 0.160 wt %, the saturation magnetic flux density decreased.

Table 9 describes Examples and Comparative Examples in which the content of Al is changed while conditions other than the content of Al are constantly maintained.

In Examples 71 to 75 in which the content of Al was 0.001 to 0.100 wt %, the melting point, the coercivity and the saturation magnetic flux density were favorable. On the other hand, in Comparative Example 13 in which Al was not contained, the melting point and the coercivity increased. In Comparative Example 20 in which the content of Al was 0.110 wt %, the saturation magnetic flux density decreased.

Table 10 describes Examples 81 to 89 in which the kind of M is changed.

In each of Examples 81 to 89, the melting point, the coercivity and the saturation magnetic flux density were favorable.

Table 11 describes Examples in which a part of Fe is substituted with X1 and/or X2 in Example 4.

From Table 11, it can be seen that favorable properties are exhibited even when a part of Fe is substituted with X1 and/or X2.

Table 12 describes Examples in which the average grain size of the initial fine crystals and the average grain size of the Fe-based nanocrystalline alloy are changed by changing the rotating speed of the roll and/or the heat treatment temperature in Example 4.

From Table 12, it can be seen that favorable properties are exhibited even when the average grain size of the initial fine crystals and the average grain size of the Fe-based nanocrystalline alloy are changed by changing the rotating speed of the roll and/or the heat treatment temperature.

The invention claimed is:

1. A soft magnetic alloy comprising a main component having a composition formula of $(Fe_{(1-(\alpha+\beta))}X1_{\alpha}X2_{\beta})_{(1-(a+b+c+d))}M_aB_bP_cC_d$ and auxiliary components including at least Ti, Mn and Al, wherein X1 is one or more selected from the group consisting of Co and Ni, X2 is one or more selected from the group consisting of Ag, Zn, Sn, As, Sb, Bi and a rare earth element, M is one or more selected from the group consisting of Nb, Hf, Zr, Ta, Mo, W and V, $0.030 \leq a \leq 0.100$ $0.050 \leq b \leq 0.150$ $0 < c \leq 0.030$ $0 < d \leq 0.030$ $\alpha \geq 0$ $\beta \geq 0$ $0 \leq \alpha+\beta \leq 0.50$, and a content of Ti is 0.001 to 0.100 wt %, a content of Mn is 0.001 to 0.150 wt %, and a content of Al is 0.001 to 0.100 wt % with respect to 100 wt % of the entire soft magnetic alloy.

2. The soft magnetic alloy according to claim 1, wherein $0.730 \leq 1-(a+b+c+d) \leq 0.918$ is satisfied.

3. The soft magnetic alloy according to claim 1, wherein $0 \leq \alpha\{1-(a+b+c+d)\} \leq 0.40$ is satisfied.

4. The soft magnetic alloy according to claim 1, wherein $\alpha=0$ is satisfied.

5. The soft magnetic alloy according to claim 1, wherein $0 \leq \beta\{1-(a+b+c+d)\} \leq 0.030$ is satisfied.

6. The soft magnetic alloy according to claim 1, wherein $\beta=0$ is satisfied.

7. The soft magnetic alloy according to claim 1, wherein $\alpha=\beta=0$ is satisfied.

8. The soft magnetic alloy according to claim 1, wherein the soft magnetic alloy comprises an amorphous phase and initial fine crystals having an average grain size in a range of 0.3 to 10 nm and has a nanohetero structure containing the initial fine crystal present in the amorphous phase.

9. The soft magnetic alloy according to claim 1, wherein the soft magnetic alloy has a structure containing a Fe-based nanocrystal.

10. The soft magnetic alloy according to claim 9, wherein an average grain size of the Fe-based nanocrystals is 5 to 30 nm.

11. The soft magnetic alloy according to claim 1, wherein the soft magnetic alloy is formed in a ribbon shape.

12. The soft magnetic alloy according to claim 8, wherein the soft magnetic alloy is formed in a ribbon shape.

13. The soft magnetic alloy according to claim 9, wherein the soft magnetic alloy is formed in a ribbon shape.

14. The soft magnetic alloy according to claim 1, wherein the soft magnetic alloy is formed in a powder shape.

15. The soft magnetic alloy according to claim 8, wherein the soft magnetic alloy is formed in a powder shape.

16. The soft magnetic alloy according to claim 9, wherein the soft magnetic alloy is formed in a powder shape.

17. A magnetic device comprising the soft magnetic alloy according to claim 1.

18. A magnetic device comprising the soft magnetic alloy according to claim 8.

19. A magnetic device comprising the soft magnetic alloy according to claim 9.

20. The soft magnetic alloy according to claim 1, wherein the content of Al is 0.005 to 0.080 wt % with respect to 100 wt % of the entire soft magnetic alloy.

* * * * *